US005234125A

United States Patent [19]

Roberts

[11] Patent Number: 5,234,125

[45] Date of Patent: Aug. 10, 1993

[54] FOOD PLATE WITH BEVERAGE CONTAINER HOLDER

[76] Inventor: Thomas J. Roberts, 4420 Candlewood La., Sylvania, Ohio 43560

[21] Appl. No.: 950,313

[22] Filed: Sep. 24, 1992

[51] Int. Cl.[5] ..... B65D 1/36

[52] U.S. Cl. ..... 220/574; 220/575; 220/23.86; 206/815; 206/562

[58] Field of Search ..... 220/23.86, 23.83, 574, 220/575; 206/815, 562

[56] References Cited

U.S. PATENT DOCUMENTS

| | | | |
|---|---|---|---|
| 3,883,029 | 5/1975 | Wyatt | 220/23.83 |
| 4,732,274 | 3/1988 | Bouton | 220/23.8 |
| 4,961,555 | 10/1990 | Egan, Jr. | 220/23.83 |
| 4,981,232 | 1/1991 | Lynn | 220/23.83 |
| 5,085,391 | 2/1982 | Berger et al. | 220/23.83 |
| 5,114,038 | 5/1992 | Laumann | 220/23.83 |

FOREIGN PATENT DOCUMENTS

| | | | |
|---|---|---|---|
| 2297023 | 8/1976 | France | 220/23.83 |

*Primary Examiner*—Joseph Man-Fu Moy

*Attorney, Agent, or Firm*—MacMillan, Sobanski & Todd

[57] ABSTRACT

A food plate has one or more openings formed through a central portion thereof for receiving a container, such as for holding beverages, food, or other items. A raised ridge is formed about the opening to prevent food from spilling off. In a first embodiment, the container has an outer surface which tapers from a smaller diameter lower end to a larger diameter upper end. In a second embodiment, a flange portion is provided on the outer surface of the container having a diameter which is greater than the diameter of the first opening. A slot may be formed from the outer peripheral edge of the food plate to the first opening to accommodate stemware styled containers. A raised ridge may be formed on or in the central portion of the food plate, extending completely about the slot to prevent food from spilling off. A second opening may be formed through the central portion of the food plate for receiving the end of a thumb therein. A raised ridge may be formed on or in the central portion of the food plate, extending completely about the second opening to prevent food from spilling off.

9 Claims, 1 Drawing Sheet

FOOD PLATE WITH BEVERAGE CONTAINER HOLDER

BACKGROUND OF THE INVENTION

This invention relates in general to food plates and in particular to an improved structure for a food plate having one or more openings formed through a central portion thereof for supporting a beverage container therein.

A food plate is a flat rigid article, typically circular in shape, having a raised lip formed about the periphery thereof to prevent food thereon from spilling off. Often, it is necessary to carry a food plate from one location to another. This is usually done by extending the fingers of one hand beneath the food plate to support the weight thereof, while simultaneously curling the thumb of the hand over the peripheral lip of the food plate to stabilize it. Often, it is also necessary to carry a beverage container at the same time in the other hand. When this occurs, it is difficult to add food onto the plate (or to consume the food thereon) without setting the beverage container down. In some instances, it may be inconvenient or undesirable to set the beverage container down to do this. Thus, it would be desirable to provide an improved structure for a food plate which includes means for supporting a beverage container thereon, thus allowing free use of the other hand.

SUMMARY OF THE INVENTION

This invention relates to an improved structure for a food plate. One or more openings are formed through a central portion of the food plate for receiving therein a beverage container. A raised ridge is formed about the opening to prevent food from spilling off. In a first embodiment of the invention, the beverage container has an outer surface which tapers from a smaller diameter lower end to a larger diameter upper end. The diameter of the lower end of the beverage container is less than the diameter of the first opening, while the diameter of the upper end of the beverage container is greater than the diameter of the first opening. Thus, the beverage container can be supported on the food plate by inserting the lower end through the first opening until the outer surface thereof engages the edge of the first opening. In a second embodiment of the invention, a flange portion is provided on the outer surface of the beverage container having a diameter which is greater than the diameter of the first opening. Thus, the beverage container can be supported on the food plate by inserting the lower end through the first opening until the flange portion thereof engages the edge of the first opening. A slot may be formed from the outer peripheral edge of the food plate to the first opening to accommodate stemware styled beverage containers. A raised ridge may be formed on or in the central portion of the food plate, extending completely about the slot to prevent food from spilling off. A second opening may be formed through the central portion of the food plate for receiving the end of a thumb therein. A raised ridge may be formed on or in the central portion of the food plate, extending completely about the second opening to prevent food from spilling off.

Various objects and advantages of this invention will become apparent to those skilled in the art from the following detailed description of the preferred embodiments, when read in light of the accompanying drawings.

DETAILED DESCRIPTION OF THE PREFERRED EMBODIMENTS

Figure 1:
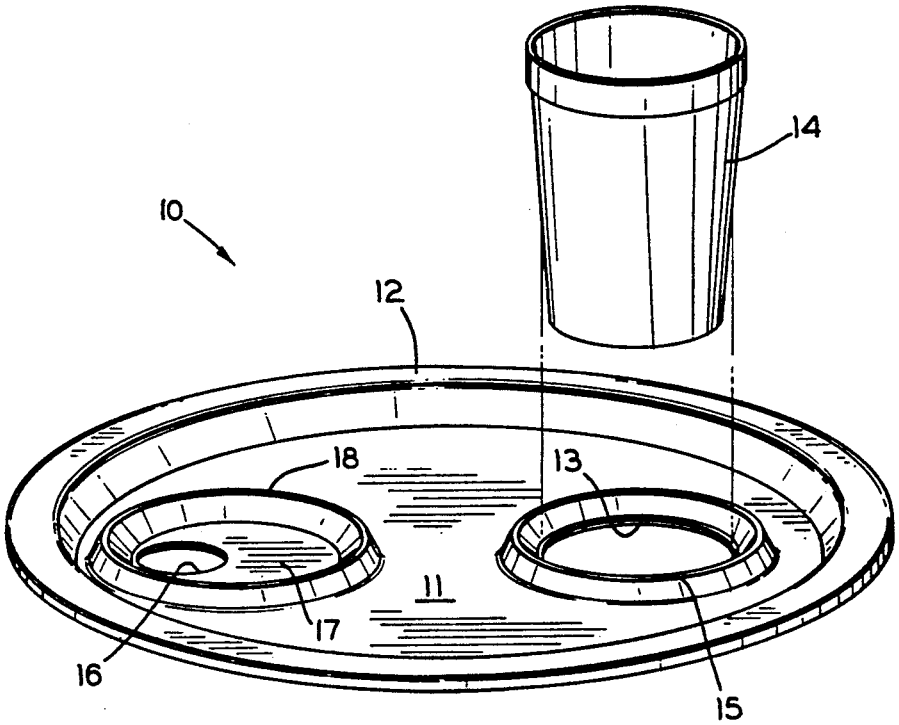
FIG. 1 is an exploded perspective view of a first embodiment of an improved structure for a food plate and beverage container in accordance with this invention.

Referring now to the drawings, there is illustrated in FIG. 1 a first embodiment of an improved structure for a food plate, indicated generally at 10, in accordance with this invention. The food plate 10 is flat and generally rigid, having a central portion 11 defining an upper surface and a raised lip 12 extending thereabout. The illustrated food plate 10 is circular in shape, although any desired shape may be used. The food plate 10 may be formed from any conventional material having sufficient rigidity to support food (not shown) on the upper surface thereof, such as paper, ceramic, and the like. The lip 12 is provided about the periphery of the central portion 11 to prevent food from spilling off the edge of the food plate 10. The food plate 10 may be formed having one or more conventional divider ridges (not shown) on the upper surface of the central portion 11 if desired.

A first opening 13 is formed through the central portion 11 of the food plate 10. As will be explained below, the first opening 13 is adapted to receive therein a container 14 to support it on the food plate 10. In the illustrated embodiment, the container 14 is designed to hold a beverage. However, the container 14 may be used to hold foods or other items. A raised ridge 15 is formed on or in the central portion 11 of the food plate 10, extending completely about the first opening 13. The ridge 15 is provided about the periphery of the first opening 13 to prevent food from spilling off the food plate 10 into the first opening 13.

In the embodiment illustrated in FIG. 1, the beverage container 14 has an outer surface which tapers from a smaller diameter lower end to a larger diameter upper end. The smaller diameter of the lower end of the beverage container 14 is less than the diameter of the first opening 13, while the larger diameter of the upper end of the beverage container 14 is greater than the diameter of the first opening 13. Thus, the container 14 can be supported on the food plate 10 by inserting the lower end through the first opening 13 until the outer surface thereof engages the edge of the first opening 13.

A second opening 16 is formed through the central portion 11 of the food plate 10. As will be explained below, the second opening 16 is adapted to receive therein a thumb (not shown) of a hand supporting the food plate 10. An enclosed area 17 is provided adjacent to the second opening 16. The enclosed area 17 may be co-planar with the central portion 11 of the food plate 10, although such is not necessary. The enclosed area 17 is provided to receive the tip of the thumb comfortably thereon. A raised ridge 18 is formed on or in the central portion 11 of the food plate 10, extending completely about the periphery of the second opening 16 and the enclosed area 17. The ridge 18 is provided to prevent food from spilling off the food plate 10 into the second opening 16 or the enclosed area 17.

Figure 2:
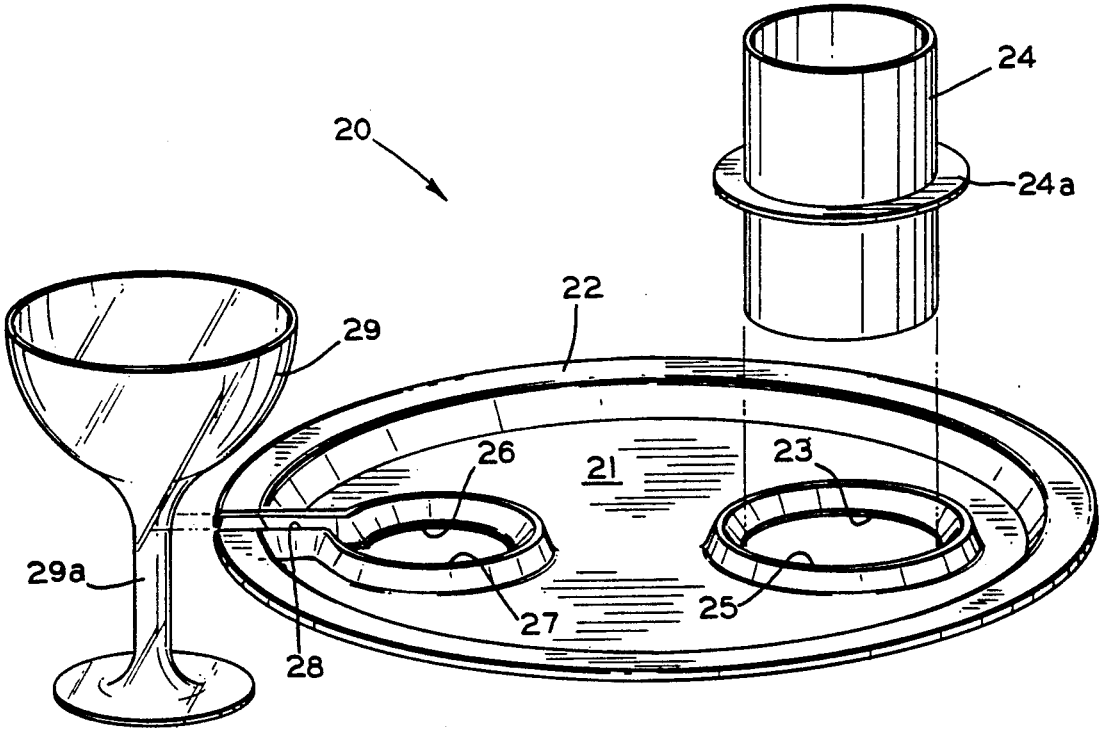
FIG. 2 is an exploded perspective view of a second embodiment of an improved structure for a food plate and beverage container in accordance with this invention.

Referring now to FIG. 2, there is illustrated a second embodiment of an improved structure for a food plate, indicated generally at 20, in accordance with this invention. The food plate 20 is similar to the food plate 10 described above, having a central portion 21 defining an upper surface and a raised lip 22 extending thereabout. Also, the food plate 20 includes a first opening 23 formed through the central portion 21 which is adapted to receive therein a beverage container 24. A raised ridge 25 is formed on or in the central portion 21 of the food plate 20, extending completely about the first opening 23.

In the embodiment illustrated in FIG. 2, however, the beverage container 24 has an outer surface defining a diameter which is less than the diameter of the first opening 23. However, a flange portion 24*a* is provided on the outer surface of the beverage container 24 having a diameter which is greater than the diameter of the first opening 23. Thus, the beverage container 24 can be supported on the food plate 20 by inserting the lower end through the first opening 23 until the flange portion 24*a* engages the edge of the first opening 23. The flange portion 24*a* may be formed integrally with the beverage container 24 or may be secured thereto by any conventional means.

A second opening 26 is formed through the central portion 21 of the food plate 20. The second opening 26 is similar to the first opening 23, having a raised ridge 27 formed on or in the central portion 21 of the food plate 20 which extends completely thereabout. However, a slot 28 is formed through the food plate 20 which extends from the peripheral edge thereof to the second opening 26. The slot 28 is provided to receive a stem portion 29*a* of a stemware styled beverage container 29. Thus, unlike the beverage container 24, the stemware styled beverage container 29 need not be completely lowered through the first opening 23. Rather, the stemware styled beverage container 29 may be supported on the food plate 20 by moving the stem portion 29*a* thereof laterally through the slot 28 until the upper portion of the stemware styled beverage container 29 is aligned over the second opening 26. Then, the stemware styled beverage container 29 is lowered a relative short distance into engagement with the central portion 21 of the food plate 20. The raised ridge 27 surrounding the second opening 26 may also extend along the periphery of the slot 28 to prevent food from spilling off. Alternatively, the slot 28 may accommodate a handle portion of a conventional cup or mug (not shown) to permit it to be used with the food plate 20 of this invention.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A food plate comprising:

a flat portion defining a surface and a periphery;

a lip formed about said periphery of said flat portion extending upwardly from said surface;

a ridge formed completely about a portion of said flat portion defining an enclosed area, said ridge extending upwardly from said surface; and an opening formed through a portion of said enclosed area within said ridge, said opening and said enclosed area being sized to receive a thumb of a hand to support said food plate.

2. The food plate defined in claim 1 further including a second opening formed through said flat portion and a container received within said second opening and supported on said food plate.

3. The food plate defined in claim 2 wherein said container has an outer surface which tapers from a smaller diameter lower end to a large diameter upper end.

4. The food plate defined in claim 3 wherein said smaller diameter of said lower end of said container is less than a diameter defined by said second opening, while said larger diameter of said upper end of said container is greater than the diameter of said second opening.

5. The food plate defined in claim 2 wherein said container has an outer surface defining a diameter which is less than a diameter defined by said second opening, and further including a flange portion provided on said outer surface of said container having a diameter which is greater than said diameter of said second opening.

6. The food plate defined in claim 1 wherein said enclosed area is co-planar with said flat portion.

7. The food plate defined in claim 1 further including a slot formed through said flat portion extending from a peripheral edge thereof to said opening.

8. The food plate defined in claim 7 wherein said ridge is formed completely about said opening and said slot.

9. The food plate defined in claim 1 wherein a plurality of openings are formed through said flat portion, each of said openings having a ridge formed completely thereabout and extending upwardly from said surface.

* * * * *